US005515688A

United States Patent [19]

Rieth

[11] Patent Number: 5,515,688

[45] Date of Patent: May 14, 1996

[54] PROCESS AND INSTALLATION FOR THE PRODUCTION OF OXYGEN AND/OR NITROGEN UNDER PRESSURE

[75] Inventor: Norbert Rieth, Paris, France

[73] Assignee: L'Air Liquide, Societe Anonyme Pour l'Etude et l'Exploitation des Procedes Georges Claude, Paris Cedex, France

[21] Appl. No.: 431,851

[22] Filed: May 1, 1995

Related U.S. Application Data

[63] Continuation of Ser. No. 198,093, Feb. 17, 1994, abandoned.

[30] Foreign Application Priority Data

Feb. 25, 1993 [FR] France ..... 93 02137

[51] Int. Cl.[6] ..... F25J 3/02

[52] U.S. Cl. ..... 62/646; 62/651; 62/654; 62/913

[58] Field of Search ..... 62/25, 38, 39

[56] References Cited

U.S. PATENT DOCUMENTS

| | | | |
|---|---|---|---|
| 2,918,802 | 12/1959 | Grunberg | 62/25 |
| 3,261,168 | 7/1966 | Ruhemann et al. | 62/13 |
| 3,375,673 | 4/1968 | Cimler et al. | 62/13 |
| 3,416,323 | 12/1968 | Heinik | 62/39 X |
| 3,589,137 | 6/1971 | Hoffman | 62/39 X |
| 4,099,945 | 7/1978 | Skolaude | 62/30 |
| 4,279,631 | 7/1981 | Skolaude | 62/38 X |
| 4,303,428 | 12/1981 | Vandenbussche | 62/13 |
| 4,526,595 | 7/1985 | McNeil | 62/39 X |
| 5,146,756 | 9/1992 | Lavin | 62/39 X |
| 5,157,926 | 10/1992 | Guilleminot | 62/38 X |
| 5,329,776 | 7/1994 | Grenier | 62/24 |

FOREIGN PATENT DOCUMENTS

| | | |
|---|---|---|
| 0420725 | 4/1991 | European Pat. Off. . |
| 1501722 | 6/1969 | Germany . |
| 2245961 | 1/1992 | United Kingdom . |

*Primary Examiner*—Christopher Kilner
*Attorney, Agent, or Firm*—Young & Thompson

[57] ABSTRACT

Process and installation for the production of gaseous oxygen and/or gaseous nitrogen under pressure, of the type in which the air is distilled in a double distillation column (10) comprising a low pressure column (12) operating under a low pressure, and a medium pressure column (11) operating under a medium pressure. All the air to be distilled is compressed (in 1,4) to at least one high pressure of air substantially greater than the medium pressure, and the compressed air is cooled to an intermediate temperature. A portion of it is expanded in a turbine (5) to the medium pressure, before introducing it into the medium pressure column (11). The non-work-expanded air is liquified, then introduced after expansion (in 19, 20), into the double column; and at least one liquid product withdrawn from the double column is brought to the production pressure, and this liquid product is vaporized by heat exchange with the air. The low pressure column (12) is operated under pressure; and the residual gas from the head of the low pressure column is expanded in the second turbine (8) after having been partially reheated. The low pressure column (12) is operated under a pressure of about 1.7 to 5 bars, and the medium pressure column (11) under a pressure of about 6.5 to 16 bars.

8 Claims, 1 Drawing Sheet

PROCESS AND INSTALLATION FOR THE PRODUCTION OF OXYGEN AND/OR NITROGEN UNDER PRESSURE

This application is a continuation of application Ser. No. 08/198,093, filed Feb. 17, 1994, now abandoned.

The present invention relates to a process for the production of gaseous oxygen and/or gaseous nitrogen under pressure, of the type in which:

air is distilled in a double distillation column comprising a low pressure column operating under a so-called low pressure, and the medium pressure column operating under a so-called medium pressure;

all the air to be distilled is compressed to at least one high air pressure substantially higher than the medium pressure;

the compressed air is cooled to an intermediate temperature, and a portion is expanded in a turbine to the medium pressure, before introduction into the medium pressure column;

the nonexpanded air is liquified then introduced after expansion into the double column; and at least one liquid product withdrawn from the double column is brought to the production pressure and this liquid product is vaporized by heat exchange with the air.

The pressures in question in the present text are absolute pressures. Moreover, the expression "liquefaction" should be understood in the broad sense, which is to say including pseudo liquefaction in the case of super critical pressures.

A process of the above type is described in FR-A-2 674 011.

The invention has for its object to improve the energy efficiency of this known process.

To this end, the invention has for its object a process of the recited type, characterized in that:

the low pressure column is operated under pressure; and the residual gas at the head of the low pressure column is expanded in the second turbine after having been partially reheated.

According to other characteristics:

the low pressure column is operated at about 1.7 to 5 bars, and the medium pressure column at a corresponding pressure of about 6.5 to 16 bars;

the inlet temperature of the second turbine is adjacent the elbow or principal elbow in the liquefaction curve of air.

The invention also has for its object an installation adapted to practice such a process. This installation, of the type comprising a double distillation column comprising a low pressure column operating under a so-called low pressure, and a medium pressure column operating under a so-called medium pressure; compression means to bring all of the air to be distilled to at least a high pressure substantially greater than the medium pressure; means for withdrawing from the double column and for pumping at least one liquid product resulting from the distillation; a heat exchange line placing in heat exchange relation the air and said liquid product; and an expansion turbine for a portion of this air, the inlet of this turbine being connected to an intermediate point in the heat exchange line and its outlet being connected to the pressure column, is characterized in that it comprises a second expansion turbine whose inlet is connected to the outlet for residual gas from the low pressure column.

An embodiment of the invention is shown in the accompanying drawings, in which.

Figure 1:
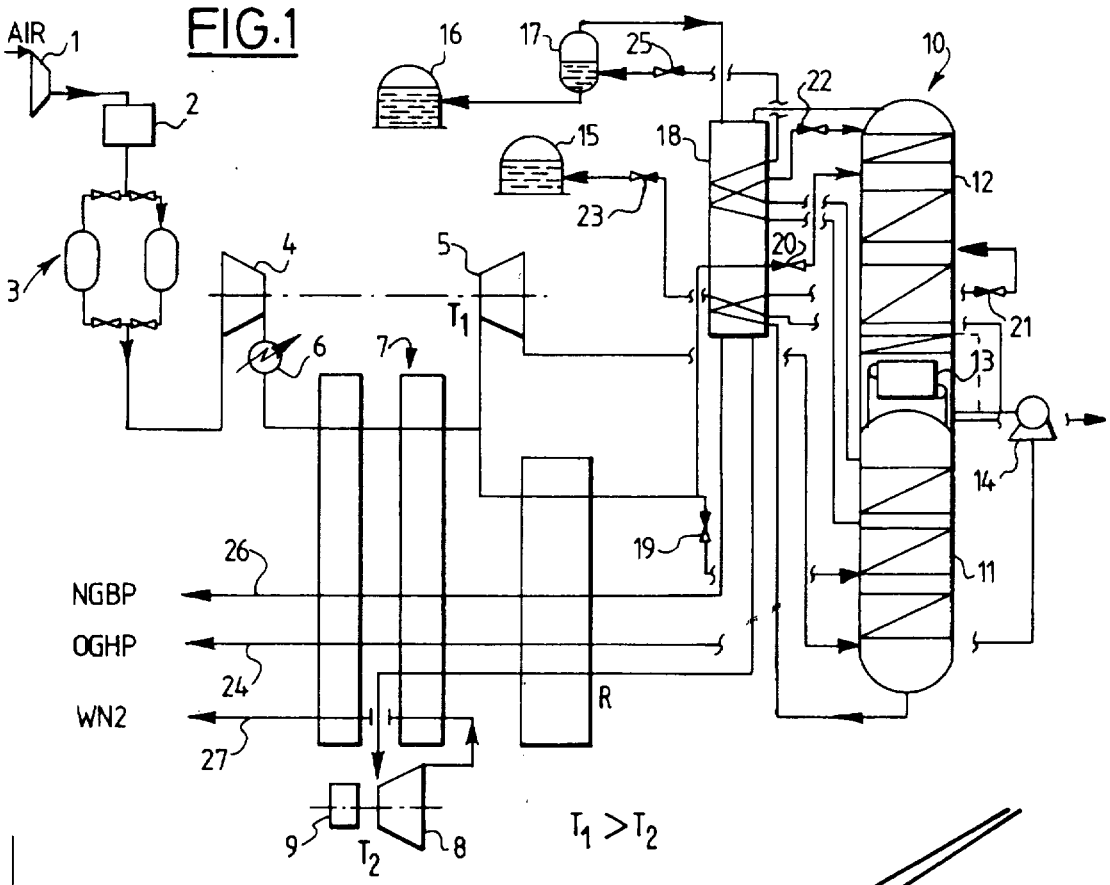
FIG. 1 shows schematically an installation according to the invention.

The installation shown in FIG. 1 is adapted to produce gaseous oxygen under high pressure of about 3 to 100 bars, gaseous nitrogen under a low pressure of about 1.7 to 5 bars, liquid oxygen and liquid nitrogen.

This installation comprises essentially: a principal air compressor 1; a pre-cooler 2; and apparatus 3 for purification by absorption; a blower-turbine assembly comprising a blower 4 and a turbine 5 whose rotors are secured to the same shaft; an atmospheric or water refrigerator 6 for the blower; a heat exchange line 7; a second expansion turbine 8 braked by an alternator 9; a double distillation column 10 comprising a medium pressure column 11 and a low pressure column 12 connected by a vaporizer-condenser 13 which places in heat exchange relation the nitrogen in the head of column 11 and liquid oxygen in the base of column 12; a liquid oxygen pump 14; a liquid oxygen storage 15 at atmospheric pressure; a liquid nitrogen storage 16 at atmospheric pressure; a phase separator 17; and a sub-cooler 18.

In operation, the column 12 is under a pressure of about 1.7 to 5 bars, and the column 11 under the corresponding pressure of about 6.5 to 16 bars.

All the air to be distilled is compressed in 1, pre-cooled in 2 to +5° to +10° C., purified of water and $CO_2$ in 3 and further compressed in 4 to the high pressure. After pre-cooling in 6 then partial cooling in 7 to an intermediate temperature T1, a portion of the air under the high pressure continues its cooling in the heat exchange line, is liquified then divided into two fractions. Each fraction is expanded in a respective expansion valve 19, 20, then introduced into the respective column 11, 12.

At temperature T1, the rest of the air under the high pressure is removed from the heat exchange line, work expanded in 5 to the medium pressure and introduced into the base of column 11.

In a conventional manner, "rich liquid" (air enriched in oxygen) withdrawn from the base of the column 11 and "pure liquid" (substantially pure nitrogen) withdrawn from the head of this column are, after sub-cooling in 18 and expansion in respective expansion valves 21 and 22, introduce at an intermediate level and into the head, respectively, of the column 12.

Liquid oxygen is withdrawn from the base of the column 12. A fraction goes directly, after sub-cooling in 18 and expansion to atmospheric pressure in an expansion valve 23, to the storage 15, while the rest is brought by the pump 14 to the desired high production pressure, then vaporized and reheated to ambient temperature in the heat exchange line before being removed via a conduit 24.

Moreover, liquid nitrogen under the medium pressure, withdrawn from the head of column 11, is sub-cooled in 18, expanded to atmospheric pressure in an expansion valve 25, and introduced into the phase separator 17. The liquid phase is sent to storage 16, while the vapor phase is reheated in 18, then in 7, and recovered as product (low pressure gaseous nitrogen) via a conduit 26.

The residual gas (impure nitrogen WN2) withdrawn from the head of the column 12 is pre-reheated in 18 then partially reheated in 7 to an intermediate temperature T2. At this temperature, the residual gas is withdrawn from the heat exchange line, expanded to atmospheric pressure in the turbine 8, which cools it, and reintroduced into the heat exchange line at the corresponding temperature, to be then reheated to ambient temperature and removed via a conduit 27.

Figure 2:
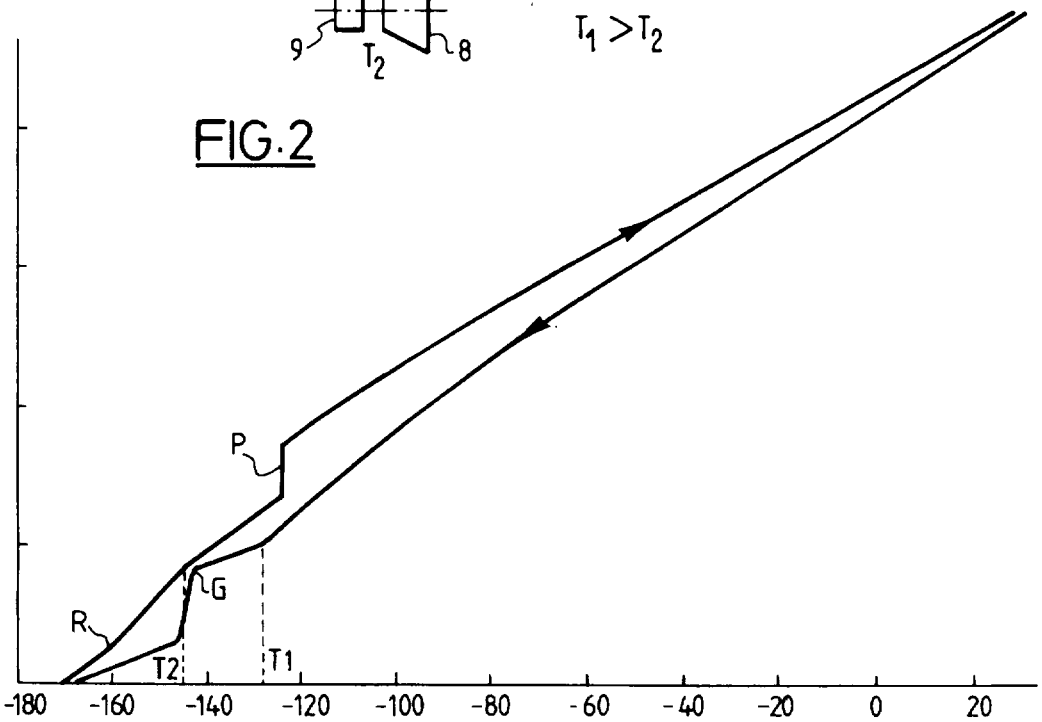
FIG. 2 is a heat exchange diagram corresponding to an example of operation of this installation, with temperatures in degrees Celsius on the abscissa and the quantities of heat exchanged between the air and the products from the double distillation column, on the ordinates.

The heat exchange diagram of FIG. 2 has been obtained by calculation with a low pressure of 2.2 bars, a medium pressure of 8.2 bars, a high air pressure of 32 bars and a high oxygen pressure of 40 bars. The temperature T1 at the inlet of turbine 5 is slightly less than the constant temperature line P of vaporization of the oxygen, and the temperature T2 at the inlet of turbine 8 is adjacent the elbow G of liquefaction of the air. The point R in the reheating curve corresponds to the reintroduction into the heat exchange line of the residual work-expanded gas, and the section of the curve of increasing slope, between this point R and the temperature T2, brings about a narrowing of the diagram in the cool part corresponding to a thermodynamic improvement of the process.

There could also be produced an increased quantity of liquid, with a reduced specific energy of production of the high pressure gaseous oxygen.

The operation under pressure of the column 12 has as a result a reduction of purity of the produced oxygen. Thus, the high pressure gaseous oxygen and liquid oxygen stored in 15 typically have a purity of the order of 95%. However, it is possible to provide several distillation plates between the withdrawals of liquid oxygen destined on the one hand for storage 15, and on the other hand for the pump 14, and thus to produce a fraction, for example 20% of the oxygen, in the form of liquid oxygen of higher purity, typically of 99.5% purity.

The invention is also applicable to the production of gaseous nitrogen under high pressure, brought by a pump (not shown) to the desired high pressure and then vaporized in the heat exchange line, and/or to the production of oxygen and/or nitrogen under several pressures, by using several high air pressures. Moreover, the vaporization of the liquid or liquids can take place in a manner which is not concomitant to the liquefaction of air, as in the example described above, or in a manner concomitant to this liquefaction.

What is claimed is:

1. A process for the production of at least one of gaseous oxygen and gaseous nitrogen under pressure, comprising:

distilling air in a double distillation column comprising a low pressure column operating under a low pressure, and a medium pressure column operating under a medium pressure;

compressing all the air to be distilled to at least one high pressure of air substantially greater than said medium pressure;

cooling the compressed air to an intermediate temperature $T_1$ lower than the vaporization temperature of at least one liquid product of the double column at a production pressure;

expanding a portion of the cooled air in a turbine to said medium pressure;

introducing said portion into the medium pressure column;

liquefying the remainder of the cooled air and expanding and introducing said remainder into the double column;

withdrawing said at least one liquid product from the double column and bringing the withdrawn product to the production pressure, and vaporizing said liquid product by heat exchange with the air;

operating the low pressure column under pressure;

withdrawing and partially reheating residual gas from the head of the low pressure column to a temperature $T_2$ lower than said temperature $T_1$, said reheating occurring at least partially, by heat exchange with the compressed air; and expanding said residual gas in a second turbine and reintroducing said residual gas into heat exchange with the compressed air to assist cooling the compressed air to the intermediate temperature $T_1$, whereby residual gas reheating and expansion acts to reduce irreversibility of the heat exchange.

2. A process according to claim 1, wherein said at least one liquid product is oxygen.

3. A process for the production of at least one of gaseous oxygen and gaseous nitrogen under pressure, comprising:

distilling air in a double distillation column comprising a low pressure column operating under a low pressure, and a medium pressure column operating under a medium pressure;

compressing all the air to be distilled to at least one high pressure of air substantially greater than said medium pressure;

cooling the compressed air to an intermediate temperature $T_1$ lower than the vaporization temperature of at least one liquid product of the double column at a production pressure;

expanding a portion of the cooled air in a turbine to said medium pressure;

introducing said portion into the medium pressure column;

liquefying the remainder of the cooled air and expanding and introducing said remainder into the double column;

withdrawing said at least one liquid product from the double column and bringing the withdrawn product to the production pressure, and vaporizing said liquid product by heat exchange with the air;

operating the low pressure column under pressure;

withdrawing and partially reheating residual gas from the head of the low pressure column to a temperature $T_2$ adjacent the condensation temperature of the air at said high pressure, said reheating occurring at least partially, by heat exchange with the compressed air; and expanding said residual gas in a second turbine and reintroducing said residual gas into heat exchange with the compressed air to assist cooling the compressed air to the intermediate temperature $T_1$, whereby residual gas reheating and expansion acts to reduce irreversibility of the heat exchange.

4. A process according to claim 3, wherein said at least one liquid product is oxygen.

5. An installation for the production of at least one of gaseous oxygen and gaseous nitrogen under pressure, comprising a double distillation column comprising a low pressure column operating under a low pressure, and the medium pressure column operating under a medium pressure; compression means to bring all the air to be distilled to at least one high pressure substantially higher than said medium pressure; means to withdraw from the double column and to pump at least one liquid product resulting from the distillation; a heat exchange line placing in heat exchange relation the air, residual gas from said low pressure column and said liquid product; an expansion turbine for a portion of said air, said turbine having an inlet connected to an intermediate point in said heat exchange line and an outlet connected to said medium pressure column having an outlet temperature $T_1$ lower than the vaporization temperature of said liquid; an outlet for said residual gas from said low pressure column having a temperature $T_2$ connected to a further intermediate point in said heat exchange line and a second expansion turbine connected to said further intermediate point, said temperature $T_2$ being lower than temperature $T_1$.

6. An installation as claimed in claim 5, wherein said liquid product is oxygen.

7. An installation for the production of at least one of gaseous oxygen and gaseous nitrogen under pressure, comprising a double distillation column comprising a low pressure column operating under a low pressure, and the medium pressure column operating under a medium pressure; compression means to bring all the air to be distilled to at least one high pressure substantially higher than said medium pressure; means to withdraw from the double column and to pump at least one liquid product resulting from the distillation; a heat exchange line placing in heat exchange relation the air, residual gas from said low pressure column and said liquid product; an expansion turbine for a portion of said air, said turbine having an inlet connected to an intermediate point in said heat exchange line and an outlet connected to said medium pressure column having an outlet temperature $T_1$ lower than the vaporization temperature of said liquid; an outlet for said residual gas from said low pressure column having a temperature $T_2$ connected to a further intermediate point in said heat exchange line and a second expansion turbine connected to said further intermediate point, said temperature $T_2$ being adjacent the condensation temperature of the air at said high pressure.

8. An installation as claimed in claim 7, wherein said liquid product is oxygen.

* * * * *